US007453337B2

(12) United States Patent
Lagorsse et al.

(10) Patent No.: US 7,453,337 B2
(45) Date of Patent: Nov. 18, 2008

(54) ADJUSTABLE TEMPERATURE COMPENSATION SYSTEM FOR MICROWAVE RESONATORS

(75) Inventors: Joël Lagorsse, Ramonville (FR); Dominique Bugada, Venerque (FR)

(73) Assignee: Thales, Neuilly sur Seine (FR)

( * ) Notice: Subject to any disclaimer, the term of this patent is extended or adjusted under 35 U.S.C. 154(b) by 244 days.

(21) Appl. No.: 11/268,621

(22) Filed: Nov. 8, 2005

(65) Prior Publication Data

US 2006/0097827 A1 May 11, 2006

(30) Foreign Application Priority Data

Nov. 9, 2004 (FR) ..... 04 52568

(51) Int. Cl.
*H01P 7/06* (2006.01)
*H01P 1/30* (2006.01)

(52) U.S. Cl. ..... 333/229; 333/234

(58) Field of Classification Search ..... 333/229, 333/234, 208, 212, 230, 232
See application file for complete search history.

(56) References Cited

U.S. PATENT DOCUMENTS 2,215,582 A 9/1940 Goldstine
2,716,222 A * 8/1955 Smullin ..... 333/229
2,752,576 A 6/1956 Hilliard
3,048,803 A * 8/1962 Schanbacher ..... 333/229
3,108,240 A * 10/1963 Riblet ..... 333/229
4,156,860 A * 5/1979 Atia et al. ..... 333/229
5,374,911 A * 12/1994 Kich et al. ..... 333/209

FOREIGN PATENT DOCUMENTS

EP 1 187 247 A2 3/2002

OTHER PUBLICATIONS

Patent Abstracts of Japan, vol. 002, No. 121 (E-063), Oct. 12, 1978 corresponding to JP 53 087149 A (Mitsubishi Electric Corp) dated Aug. 1, 1978.

* cited by examiner

*Primary Examiner*—Benny Lee
*Assistant Examiner*—Kimberly E Glenn
(74) *Attorney, Agent, or Firm*—Sughrue Mion, PLLC

(57) ABSTRACT

A device comprises a microwave resonator having at least one cavity having a predefined resonant frequency. The device also comprises a temperature compensation system that is made from a material having a coefficient of thermal expansion that is very low compared to that of the material from which the cavity is made and includes a structure for counteracting the effects of temperature variations on the resonator so that the resonant frequency of the cavity remains within a predetermined range. The device further comprises a temperature compensation adjustment device adapted to modify the volume of the cavity to adjust the value of the resonant frequency to a predefined value. The cavity comprises a cylindrical wall having a longitudinal axis and two opposite ends, one of which is blocked by a deformable cap, and the temperature compensation system and the temperature compensation adjustment device are coupled to each other and to the resonator so as to exert forces on the cap of the cavity along an axis corresponding to the longitudinal axis of the cavity.

8 Claims, 2 Drawing Sheets

ADJUSTABLE TEMPERATURE COMPENSATION SYSTEM FOR MICROWAVE RESONATORS

CROSS-REFERENCE TO RELATED APPLICATIONS

This application is based on French Patent Application No. 04 52 568 filed 09/11/2004, the disclosure of which is hereby incorporated by reference thereto in its entirety, and the priority of which is hereby claimed under 35 U.S.C. §119.

BACKGROUND OF THE INVENTION

1. Field of the Invention

The invention relates to microwave resonators generally used in the field of terrestrial or space communications.

2. Description of the Prior Art

A microwave resonator is an electromagnetic circuit that is tuned to pass energy at a precise resonant frequency.

Microwave resonators can be used to produce filters to reject the frequencies of a signal that are outside the passband of the filter.

A resonator takes the form of a structure forming a resonant cavity whose dimensions define the required resonant frequency.

Accordingly, any change in the dimensions of the cavity introducing a change in the volume thereof causes a shift in its resonant frequency and consequently a change in the passband of the filter.

Changes in the dimensions of a resonant cavity may result from expansion or contraction of the walls of the cavity caused by changes of temperature, and increase in proportion to the coefficient of thermal expansion of the material.

There are several prior art techniques for compensating the variation in cavity volume caused by changes in temperature in order to maintain the resonant frequency at the predefined value under normal temperature conditions (ambient temperature around 20° C.).

These techniques are usually based on the use of components that are part of the structure of the cavity itself and are made of materials with different coefficients of thermal expansion, one of the coefficients being much lower than the other(s). These components are arranged so that expansion occurs in opposite direction, causing a deformation of the cavity if the temperature rises that reduces its volume.

A first material is conventionally used having a very low coefficient of thermal expansion, such as Invar® (Registered Trade Mark). The second material used is generally aluminum, which has a higher coefficient of thermal expansion than Invar® but which on the other hand, in addition to its low density and therefore its lightness, has a high thermal dissipation power, making it particularly suited to space applications.

There also exist compensation devices external to the cavity based on the same principle of using two materials with different coefficients of thermal expansion. For more details see the description of a temperature compensation device given in patent application EP 1 187 247 of 28 Aug. 2001, for example.

The drawback of these various solutions is that each temperature compensation device must have dimensions adapted to the length of the resonant cavity with which it is associated or of which it forms part. Thus temperature compensation devices must be produced with dimensions adapted to each different cavity length.

The present invention solves this problem by proposing a system equally suited to cavities of the same length and to cavities of different lengths.

The invention further proposes a temperature compensation system the adjustment device whereof confers high temperature stability on the resonator.

SUMMARY OF THE INVENTION

The present invention consists in a system comprising a microwave resonator having at least one cavity having a predefined resonant frequency, the device also comprising a temperature compensation system that is made from a material having a coefficient of thermal expansion that is very low compared to that of the material from which the cavity is made and includes a structure for counteracting the effects of temperature variations on the resonator so that the resonant frequency of the cavity remains within a predetermined range, and the device further comprising a temperature compensation adjustment device adapted to modify the volume of the cavity to adjust the value of the resonant frequency to a predefined value, in which device the cavity comprises a cylindrical wall having a longitudinal axis and two opposite ends, one of which is blocked by a deformable cap, and the temperature compensation system and the temperature adjustment device are coupled to each other and to the resonator so as to exert forces on the cap of the cavity along an axis corresponding to the longitudinal axis of the cavity.

In a preferred embodiment the cavity comprises a base blocking one end of the cavity and a rod joined to the base and extending out of the cavity along the longitudinal axis thereof and the compensation adjustment device is disposed around the rod and consists of a component of the temperature compensation system that is made from a material having a very low coefficient of thermal expansion.

The compensation adjustment device advantageously comprises a screw made from a material having a very low coefficient of thermal expansion, being threaded on its exterior wall and having a hollow shaft into which the rod of the cap passes.

According to another feature, the temperature compensation system comprises two rods made from a material having a very low coefficient of thermal expansion and diametrically opposed with respect to the cavity, which has two fins to each of which one of the rods is fixed.

The rods are on either side of the base of the cap and are coupled together above the base by a stirrup member incorporating a threaded passage for the hollow shaft screw and the rod of the cap passing through the screw.

The compensation adjustment device includes a lock-nut around the screw above the stirrup member.

According to another feature, the cavity of the resonator and its fins are defined by an aluminum wall and the compensation adjustment screw is made of Invar®.

Other features and advantages of the invention will become clearly apparent on reading the following description, which is given by way of illustrative and non-limiting example and with reference to the appended drawings.

DETAILED DESCRIPTION OF THE PREFERRED EMBODIMENT

Figure 1:
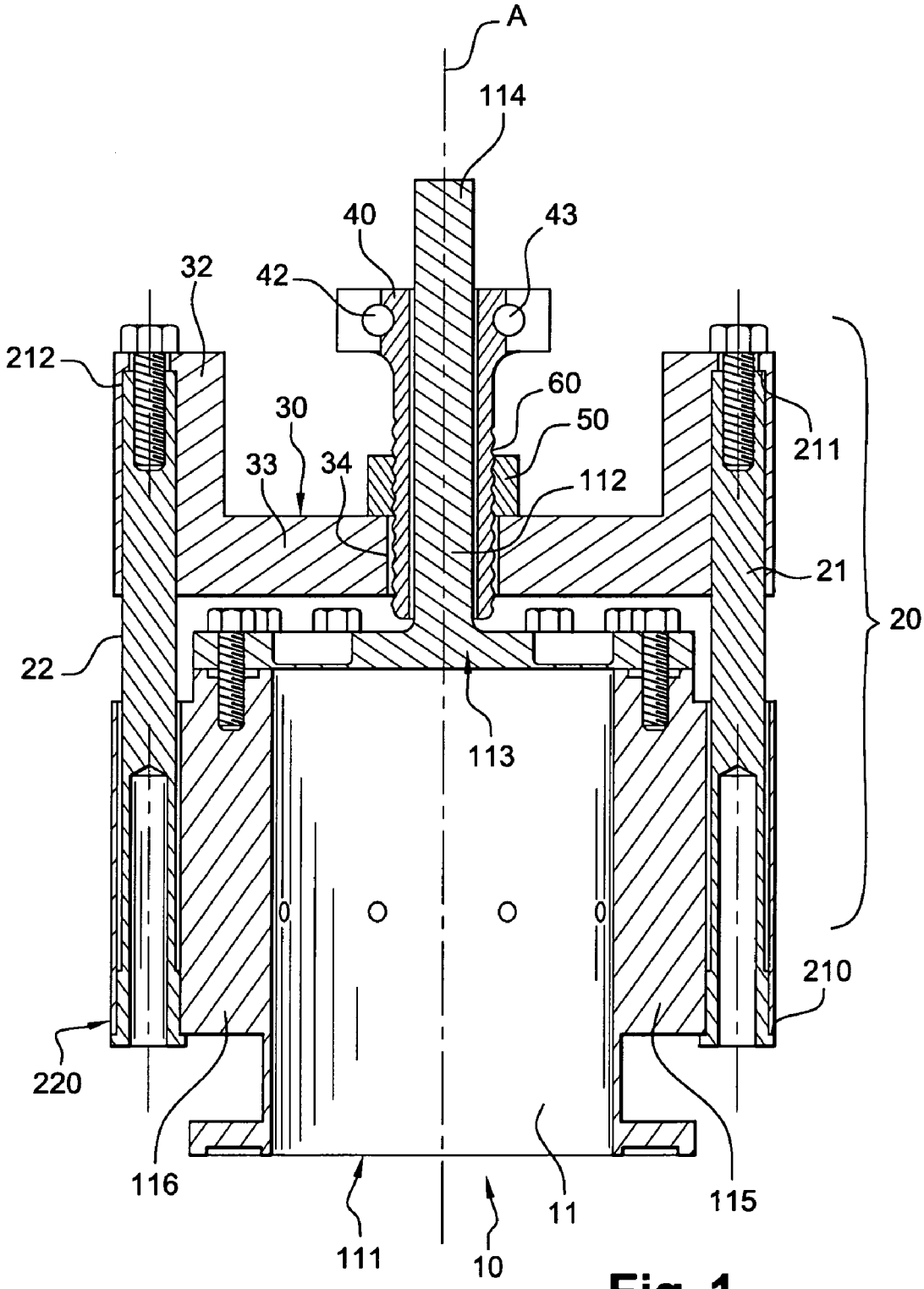
FIG. 1 is a diagrammatic view in cross section of a preferred embodiment of a device of the present invention.

The device 1 shown in FIG. 1 comprises at least one microwave resonator 10, one temperature compensation system 20 for that resonator and one compensation adjustment device 40. In a preferred embodiment, the temperature compensation system includes the compensation adjustment device 40.

Thus the compensation system 20 is used to compensate variations in the volume of the cavity of the resonator caused by an increase in temperature by modifying the volume of the cavity so that the resonant frequency of the cavity remains within a predetermined range.

The adjustment system enables the volume of the cavity to be corrected by increasing it or decreasing it if the compensation is insufficient to obtain a cavity whose resonant frequency corresponds to the predefined resonant frequency, i.e. the resonant frequency of the cavity when operating under normal temperature conditions.

The temperature compensation and adjustment system of the invention therefore enables the resonant frequency of a resonator to be maintained despite variations in temperature to which it may be subjected, even if the cavities of the resonators have slightly different lengths (of the order of one to a few millimeters).

In all cases, the adjustment device of this system confers high temperature stability on the resonator.

The resonator 10 shown in FIG. 1 takes the form of a cylindrical cavity 11 with a bottom 111, which may be coupled to another cavity (shown in FIG. 2), and a cap 112. The cap 112 has a cylindrical base 113 fixed to the cavity and extended by a rod 114 of smaller diameter situated on the longitudinal axis of the cavity 11.

The cavity 11 has on its exterior wall two diametrally opposite fins 115 and 116 extending over substantially the top three-quarters of its height, i.e. at the cap end.

To the bottom ends 210 and 220 of these fins are fixed respective rods 21 and 22 made from a material with a very low coefficient of thermal expansion. The rods extend on either side of the base of the cap 113, parallel to its longitudinal axis, i.e. to its rod 114.

The upper ends of the two rods are fixed to a stirrup member 30 having a portion 32 in which the ends of the rods 21 and 22 are nested and a transverse portion 33 extending between the rods and incorporating a passage 34 for the rod 114 of the cap, thereby encircling the latter and a member 40 for clamping the rod of the temperature compensation system. This member 40 is made from a material with a very low coefficient of thermal expansion. The combination of these members provides temperature compensation.

Thus the rods are positioned on either side of the plane of the base 113 of the cap, which is taken as a reference plane for deformations to which the cap may be subjected by the temperature compensation system and the compensation adjustment system.

The temperature compensation adjustment system comprises the clamping member 40. To this end, this member 40 takes the form of a screw 40 having a hollow shaft whose diameter is adapted to the diameter of the rod 114 so that it can be placed around the rod. The screw penetrates the threaded passage 34 in the stirrup member 30. The exterior wall of the screw 40 is threaded and its internal wall is smooth. The rod 114 is smooth, the fit between the rod 114 and the screw 40 is a sliding fit, and the connection between the two members is effected by adhesion (clamping) of the screw 40 to the rod 114 by means of screws 62 and 63 accommodated in the head 41 of the screw.

Thus the screw 40 may be raised or lowered around the rod 114. A lock-nut 50 is placed above the passage formed in the stirrup member 30 to fix the position of the screw when the latter is adjusted.

The head 41 of the screw 40 is split and forms a plurality of portions having an elasticity which, when they are clamped, clamps the rod 114. To this end, the head 41 of the screw includes two housings that are diametrically opposite with respect to the axis of the rod 114 and through which the two screws 62 and 63 pass in opposite directions to clamp the portions of the head around the rod 114.

The rods 21, 22 and the screw 40 are made from a material having a very low coefficient of thermal expansion, such as Invar®), for example.

The resonator 10, comprising the cavity 11, its fins 115, 116 and the cap 112, is made from a material having a high thermal dissipation power, such as aluminum, for example, but having a coefficient of thermal expansion higher than that of the rods 21 and 22 and the screw 40.

The temperature compensation system comprises the two rods joined to the cavity and to the cap by way of the stirrup member and the screw.

The position of the screw 40 is adjusted after resonant frequency measurements carried out under the real life conditions of operation of the 10 resonator, i.e. after subjecting the resonator to the temperatures at which it will be required to operate.

Accordingly, when the cavity tends to expand lengthwise because of an increase in temperature, the rods and the screw exert forces on the axis of the cap that deform it.

The resonant frequency remains within a predetermined range of values. The compensation is adjusted by screwing the screw 40 in or out to alter the resonant frequency to the predefined value.

The adjustment device 40 offers a range of approximately ±10% of the nominal compensation provided by the rods and the screw, this range being obtained by adjusting the position of the screw.

Figure 2:
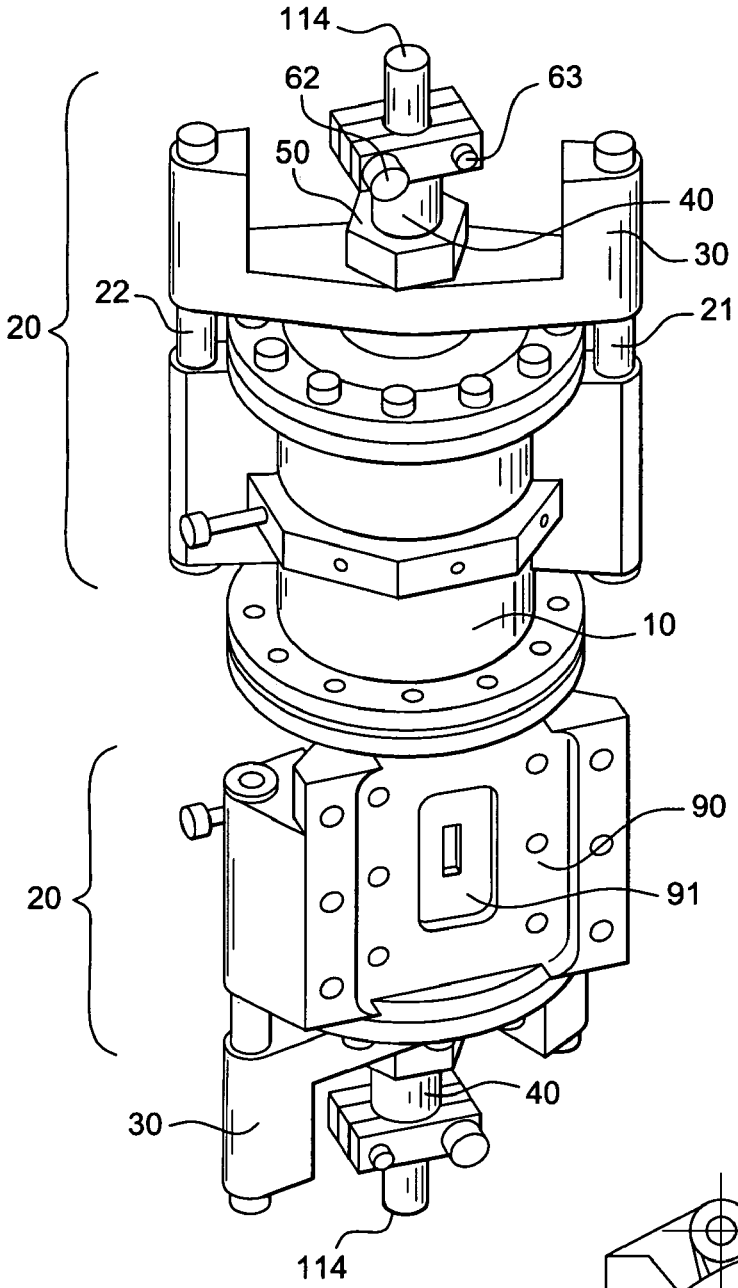
FIG. 2 is a diagrammatic representation of a device with two resonant cavities.

FIG. 2 is an overall view of a device of the invention. In this example, the resonator comprises two coupled resonant cavities 10 and 90.

Each resonant cavity is equipped with a temperature compensation system 20 and a compensation adjustment device 40 according to the present 25 invention. The signal input 91 to the cavity 90 can be seen. The screws 62, 63 for adjusting the rod 114 can be seen in this figure and in FIG. 3.

Figure 3:
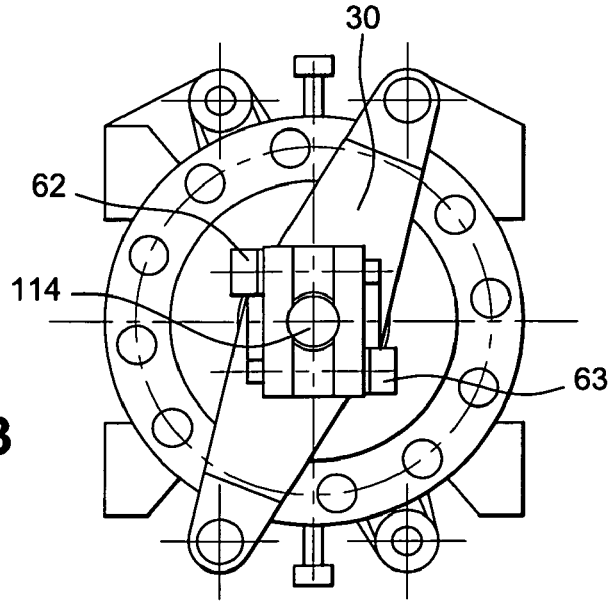
FIG. 3 is a plan view of a temperature compensation adjustment screw.

FIG. 3 shows the conformation of the head 41 of the compensation adjustment screw 40.

There is claimed:

1. A system comprising a microwave resonator having at least one cavity having a predefined resonant frequency, said device also comprising a temperature compensation system that is made from a material having a coefficient of thermal expansion that is very low compared to that of a material from which said cavity is made and includes a structure for counteracting the effects of temperature variations on the resonator so that the resonant frequency of said cavity remains within a predetermined range, and said system further comprising a temperature compensation adjustment device adapted to modify the volume of said cavity to adjust the value of said resonant frequency to a predefined value, in which device said cavity comprises a cylindrical wall having a longitudinal axis and two opposite ends, one of which is blocked by a deformable cap, and said temperature compensation system and said temperature compensation adjustment device are coupled to each other and to said resonator so as to exert forces on said cap of said cavity along an axis corresponding to the longitudinal axis of said cavity, the adjustment device are configured to enable the volume of the cavity to be corrected by increasing or decreasing said volume if the compensation is insufficient to obtain a cavity whose resonant frequency corresponds to the predefined resonant frequency.

2. A system comprising a microwave resonator having at least one cavity having a predefined resonant frequency, said system also comprising a temperature compensation system that is made from a material having a coefficient of thermal expansion that is very low compared to that of a material from which said cavity is made and includes a structure for counteracting the effects of temperature variations on the resonator so that the resonant frequency of said cavity remains within a predetermined range, and said system further comprising a temperature compensation adjustment device adapted to modify the volume of said cavity to adjust the value of said resonant frequency to a predefined value, in which device said cavity comprises a cylindrical wall having a longitudinal axis and two opposite ends, one of which is blocked by a deformable cap, and said temperature compensation system and said temperature compensation adjustment device are coupled to each other and to said resonator so as to exert forces on said cap of said cavity along an axis corresponding to the longitudinal axis of said cavity, wherein said cap comprises a base blocking one end of said cavity and a rod joined to said base and extending out of said cavity along said longitudinal axis thereof and said compensation adjustment device is disposed around said rod and consists of a component of said temperature compensation system that is made from a material having a very low coefficient of thermal expansion.

3. The system according to claim 2, wherein said compensation adjustment device comprises a screw made from a material having a very low coefficient of thermal expansion, being threaded on its exterior wall and having a hollow shaft into which said rod of said cap passes.

4. The system according to claim 3, wherein said temperature compensation system comprises two rods made from a material having a very low coefficient of thermal expansion and diametrically opposed with respect to said cavity, which has two fins to each of which one of said rods is fixed.

5. The system according to claim 4, wherein said rods are on either side of said base of said cap and are coupled together above said base by a stirrup member incorporating a threaded passage for said hollow shaft screw and said rod of said cap passing through said screw.

6. The system according to claim 5, wherein said compensation adjustment device includes a lock-nut around said screw above said stirrup member.

7. The system according to claim 4, wherein said cavity of said resonator and its fins are defined by an aluminum wall.

8. The system according to claim 3, wherein said compensation adjustment screw is made of a nickel-iron alloy.

* * * * *